US005306004A

United States Patent [19]

Soong

[11] Patent Number: 5,306,004

[45] Date of Patent: Apr. 26, 1994

[54] SPORTS RACKETS HAVING ALL STRINGS DAMPENED FOR VIBRATION

[76] Inventor: Tsai C. Soong, 1839 Jackson Rd., Penfield, N.Y. 14625

[21] Appl. No.: 975,064

[22] Filed: Nov. 12, 1992

[51] Int. Cl.[5] ..... A63B 49/02

[52] U.S. Cl. ..... 273/73 C; 273/73 D

[58] Field of Search ..... 273/73 R, 73 C, 73 D, 273/73 E, 73 F, 73 G, 73 H, 73 K

[56] References Cited

U.S. PATENT DOCUMENTS

| | | | |
|---|---|---|---|
| 3,986,716 | 10/1976 | Taussig et al. | 273/73 C |
| 4,185,822 | 1/1980 | Li | 273/73 C |
| 4,891,175 | 1/1990 | Haines | 273/73 C X |
| 4,930,778 | 6/1990 | Mizuno | 273/73 D |
| 4,993,711 | 2/1991 | Deville et al. | 273/73 D |
| 5,009,422 | 4/1991 | Soong | 273/73 D |
| 5,141,228 | 8/1992 | Soong | 273/73 D |

FOREIGN PATENT DOCUMENTS

| | | | |
|---|---|---|---|
| 2186804 | 8/1987 | United Kingdom | 273/73 D |
| 2253798 | 9/1992 | United Kingdom | 273/73 D |

*Primary Examiner*—William Stoll

*Attorney, Agent, or Firm*—Bernard A. Chiama

[57] ABSTRACT

A sports racket having a top portion, two lateral portions connecting the top portion to a throat, a shank portion, a handle, and a string network of longitudinal and cross strings defining a string network, is disclosed as having a frame structure with a T-shaped cross-section of a central member and a vertical member, the former having a plane of symmetry coinciding with the plane of the string network. The central member is arranged so that the strings wrap around the same as the strings enter and exit the frame. The improvement includes damping strips fastened to upper and lower surfaces of the central member positioned on either side of the plane of the string network to be engageable with the strings as they enter and leave the frame during vibration thereof.

10 Claims, 4 Drawing Sheets

SPORTS RACKETS HAVING ALL STRINGS DAMPENED FOR VIBRATION

BACKGROUND OF THE INVENTION

A major research area in sports rackets employing strings to bounce the ball is about string and frame vibration caused by the impact of the ball on the string network. Upon the impact, the string network will vibrate, mostly in up and down harmonic motions with gradually diminishing amplitude perpendicular to the plane of the string network. The motion of the strings will propagate to the frame to which the ends of the strings are attached. Then the frame will begin its own in-plane and out-of-plane vibration modes executed along with the strings' vibration until the energy is spent by internal molecular friction.

There have had many prior arts with arrangements to reduce the string vibration. For example, the ends of some strings, near the throat or frame, may be anchored through a cushion device installed inside a throat member or frame to absorb shock caused by the affected strings' sudden tightening. Or, a damping device, commonly in the form of elastic buttons, attached onto a string to drag the string against up-and-down vibratory motion. However, there has been no invention which could have all the strings in a sports racket cushioned against vibration. The difficulty for an effective improvement like that lies in weight consideration of a racket since good performance depends on having its weight optimally reduced and controlled. The present invention is able to cushion all strings in a racket against up-and-down vibratory motion with minimum weight penalty and accomplishes this in an ingenious way by taking advantage of a special frame structure herein the frame is primarily designed for minimum weight and provides for the addition of damping devices applied to the frame to damp all strings thus requiring no additional structural arrangement.

DESCRIPTION OF THE PREFERRED EMBODIMENT

The present invention applies to general sports rackets which employ strings to bounce a ball. For convenience, the tennis racket is taken as example.

Figure 1:
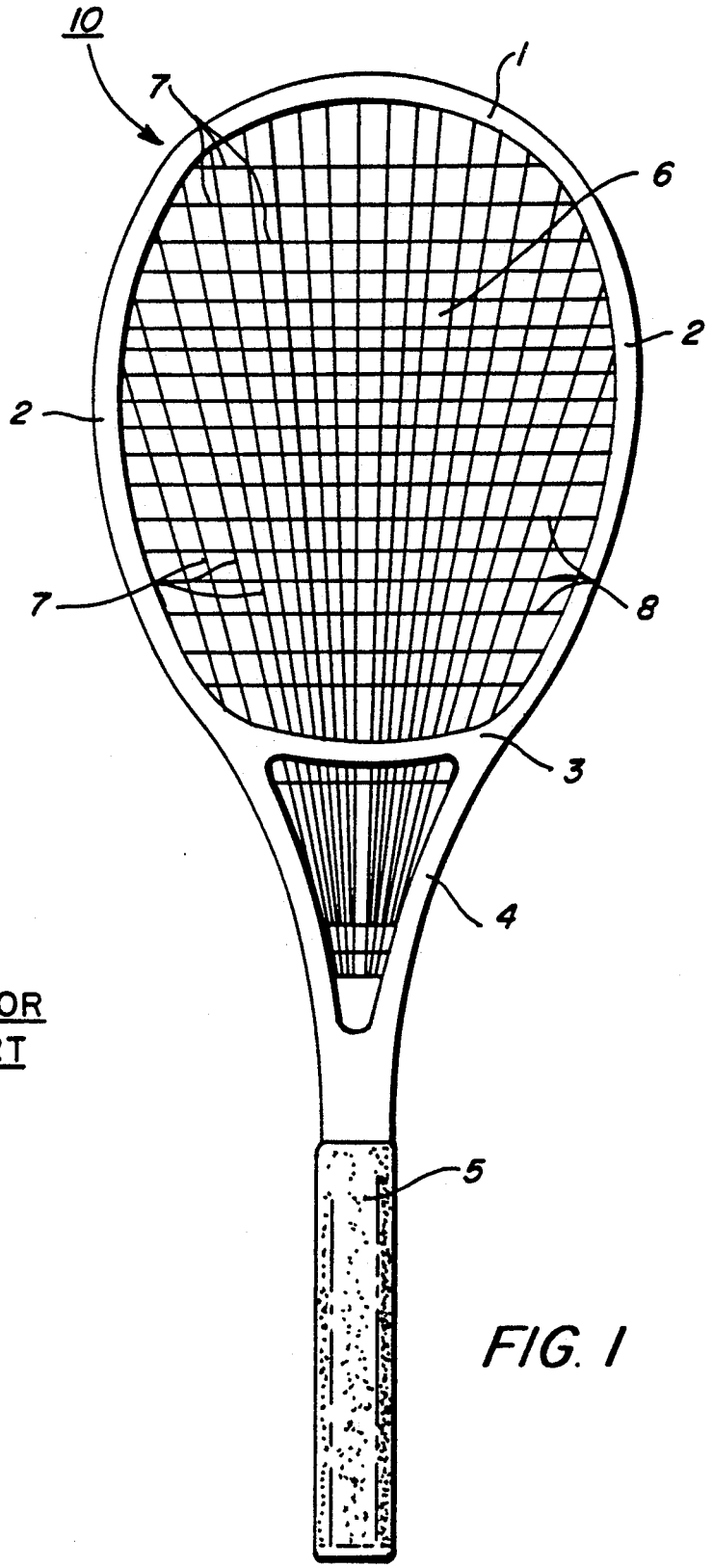
PRIOR ART FIG. 1
FIG. 1 shows a conventional tennis racket.

FIG. 1 shows a conventional tennis racket 10 where the frame has a top portion 1, two lateral portions 2 connecting 1 to the throat 3, and a shank portion 4 spans 3 to the handle 5. The string network 6 consists of a system of longitudinal strings 7 interwoven with a cross string system 8 approximately perpendicular to each other.

Figure 2:
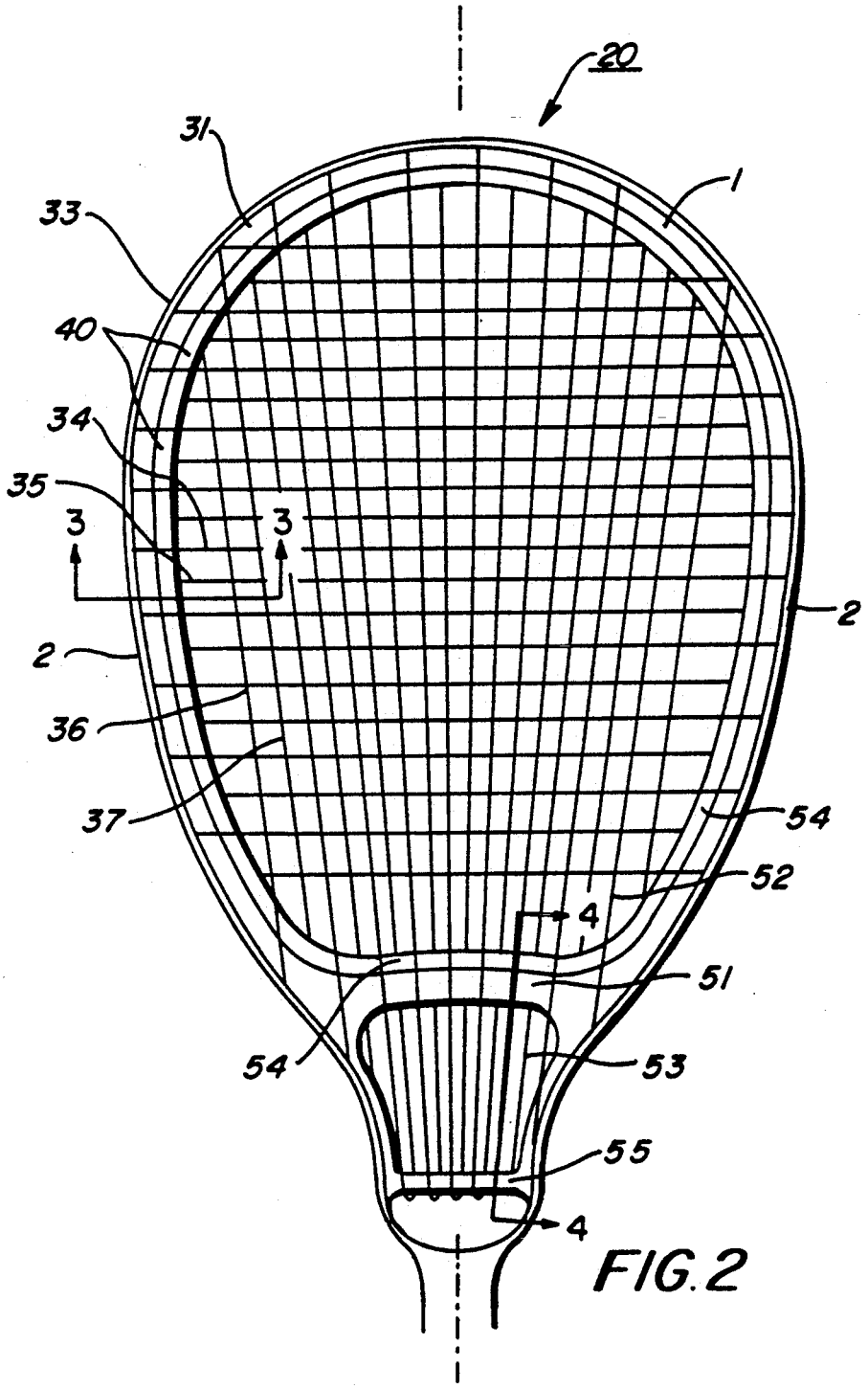
FIG. 2 shows an embodiment of the invention.
Figure 3:
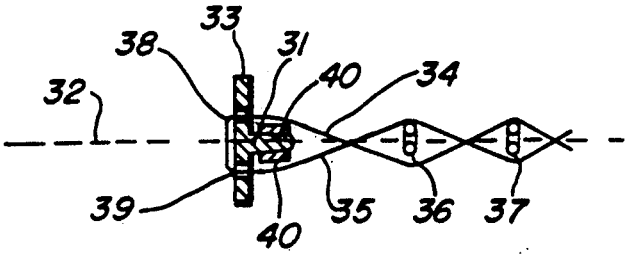
FIG. 3 shows a cross-sectional view taken along the line 3—3 in FIG. 2 to illustrate the T-shaped cross-section of the frame.

FIG. 2 shows an embodiment of the invention. In the racket 20, the frame in portions 1 and 2 has an approximately T-shape cross as shown in FIG. 3, comprising a horizontal, central member 31, symmetric to the plane of the string network 32, and a vertical member 33 which is also symmetric, which may be flat or curved. Either may be solid or hollow. Such a frame, if the section is solid, can be most economically produced by the injection molding method, using reinforced thermoplastic material, such as short graphite fibers in Nylon based matrix. Such a section is a very efficient structural member for resisting bending moment in the plane of the string network from the string force and also from the ball load which bends the frame in the plane perpendicular to the plane of the string network. Adjacent cross strings 34 and 35 are seen as rounding the member 31 from an upper string hole 38, rounding from the lower string hole 39, both holes being formed in at the member 33, and weaved through the closest longitudinal strings 36 and 37, forming an approximate flat string network. The invention requires that member 31 be short at the inboard side enough to allow the first cross over between the longitudinal string and the cross strings, such as 36 to 34, to occur at a spaced distance away from the inner edge of the frame. Damping strips 40 are fastened on the surfaces of both upper and lower sides of the central member 31 which are symmetrically spaced on either side of the member 31. The strips 40 will be compressed against the respective surfaces of the upper and lower sides by the overhead strings 34 and 35. The material of the strips is conventional energy absorbing synthetics or other types. As a consequence, the strings are effectively damped against vibration. Therefore, all strings anchored in the top region and the lateral side regions are damped in the way described. Since the strings are alternately passing over 31 as shown, approximately half of them are damped by the pads or strips at the upper surface of 31 and the other half by the pads or strips at the lower side of 31. A feature of the design is that nearly all of the width of 31 is enclosed between the two incoming and outgoing string systems and damping is being accomplished by the pressure created in having the strings enclosing the structure member through the cushioning padding. The damping strips are preferred to be continuous, unbrokenly fastened on the frame surrounding the ball play area as is seen in FIG. 2, but separate pads strips supporting individual strings are allowed. Since 31 is a primary structural member of the frame, the effective damping of all strings is being accomplished without adding any other supportive members to the frame.

A prior art, U.S. Pat. No. 5,009,422, by Soong, 1991, had suggested a similar T-section with strings passing through both sides of a central member. However, major differences with the present invention do exist. Soong teaches to avoid touching of the strings with the central member. It is preferred in his FIG. 5 to have the inboard horizontal member tapered to provide adequate clearance for merging of the strings in the network. Its merit, as claimed by Soong, is enlarging the effective string network area which requires the inboard part of the member to be tapered and strings should not touch the structure member, not only to avoid damage but also not to interfere with the movement of the strings. However, it was found in this application by play tests that the contact between the strings and the frame if done through a damping pad placed at the inboard part of the central member, as suggested by the invention, will not damage the string because the pad strips prevented rubbing. Furthermore, it was found the reduction of the free vibration area of the string network due to contact does not reduce power and control, because mostly what the string did when hit was being axially strained more, which will store the same amount of energy which means power is not affected. Surprisingly, control is actually enhanced because when the free vibration area is reduced, the ball will sink deeper and the string will deflect more sharply, the subtended angle formed by the string containing the ball becomes smaller and the direction of rebounding of the ball is more precisely oriented and is less random. The net effect is like to have a large head size frame replaced by a medium head size frame which always improves control. This is a surprise discovery. It clears an obstacle for the invention.

Figure 4:
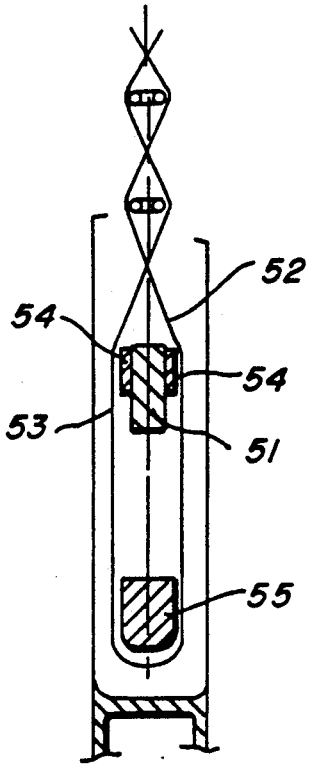
FIG. 4 shows a cross sectional view of the throat and the string post taken along the line 4—4 in FIG. 2.

The longitudinal string group may be anchored at the other end at the throat 51 or to a string post 55. If they are anchored at a string post behind the throat, they should pass the throat alternately either above or below as shown in FIG. 4. In FIG. 4, longitudinal string 52 passes above the throat 51, turns around the string post 55 and passes below the throat as 53. Other designs are possible. A damping pad strip 54 fastened to the throat on both sides provides damping for the strings. This pad may be a part of a continuous integral damping strip all around the ball playing area of the frame.

Figure 5:
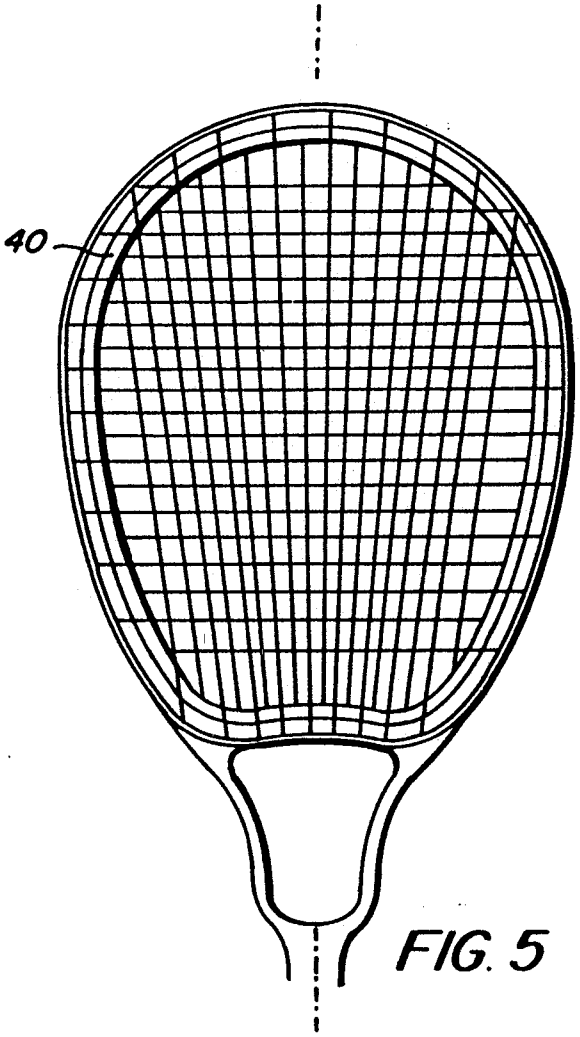
FIG. 5 shows an embodiment of the frame without the string post.

The longitudinal strings may be anchored at the throat 51 and the string post is eliminated. This is shown in FIG. 5. Notice the unbroken continuous damping strip encircling the ball playing area of the racket, damped all strings, in FIG. 2 and FIG. 5. No prior art suggested an arrangement that can achieve it in a practical way.

Figure 6:
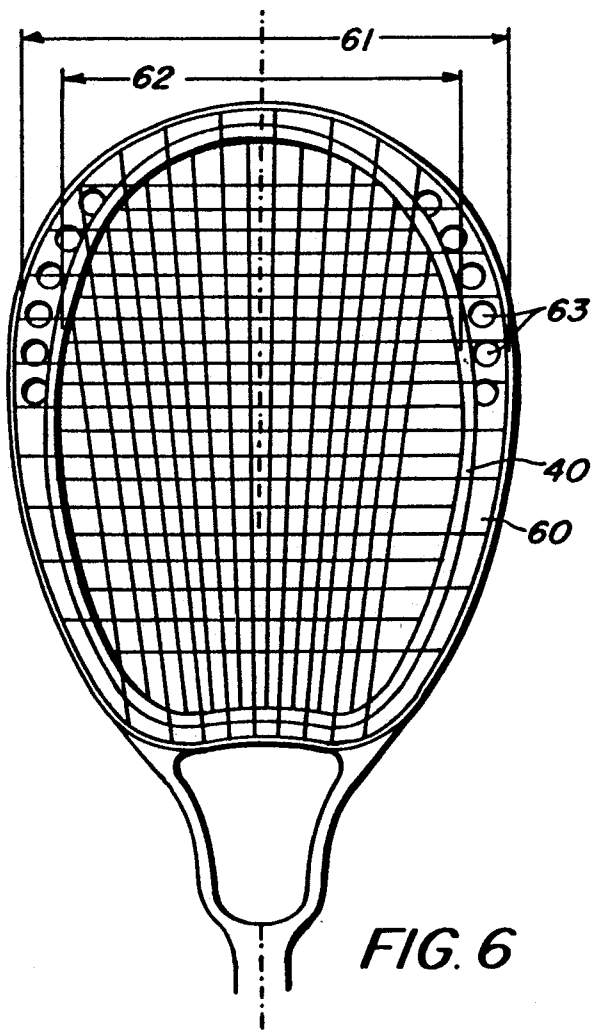
FIG. 6 shows an embodiment of the frame with variable width members.

In FIG. 6, the frame of the racket is shown as having a T-shape section with variable width of the central member 60 along the frame's longitudinal axis is shown. In this embodiment, the central member is wider in the lateral region of the racket than at the top region. The cross strings' length 61 is quite long from end to end, but the ball playing width of the network there, 62, is narrowed. The string network has the capacity to store energy as a large head sized racket in terms of power, however, it will have improved the control as a medium sized head racket. Lightening openings 63 are made as shown to reduce weight.

A prior art, U.S. Pat. No. 4,988,101, Soong, 1991, exhibits a string post similar to the sketch of FIG. 4 in which the string post 55 is being wrapped by the passing strings 52 and 53. Even though Soong in the specification did not disclose how the strings are to pass through the throat, its FIG. 3 showed the strings are to pass in the interior of the throat rather than exterior. As a matter of fact, very few, almost none, of the prior art had shown a design in which strings 52, 53, are to pass a throat 51 from above or below as in FIG. 4, for the obvious reason that no prior art had thought of any useful purpose to have strings enclosing a structural member, as in the case of 31 of FIG. 3 and 51 of FIG. 4, rather than comfortably inside it with sufficient clearance.

Figure 7:
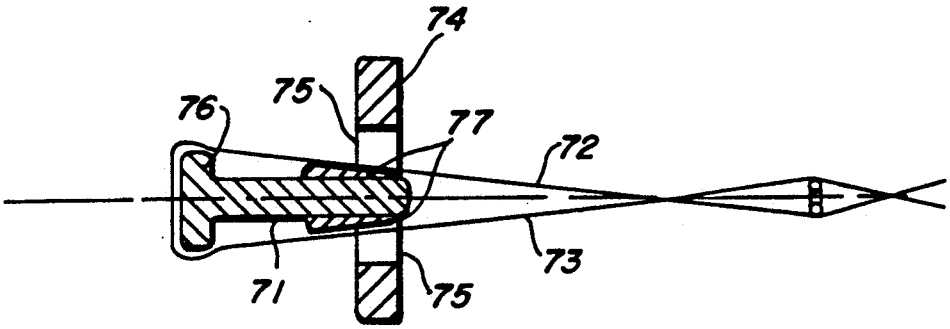
FIG. 7 shows a cross sectional view of another embodiment of the T-shape section.

FIG. 7 shows yet another alternate T-shape cross section to be used in the frame. Contrary to FIG. 3, the horizontal central member 71 extends towards the outboard direction of the frame and the in and out strings 72 and 73 pass the vertical member 74 through openings 75 made in 74 and a turn around is made about an outer edge 76 of the central member. The height of 76 is much smaller than the height of 74. Damping pad strips 77 may be placed on the upper and lower sides of the central member 71. The merit of this design is that the frame is having a geometry of a mid-sized frame but the string network size is larger than the nominal frame size defined by the location of the large vertical member.

Figure 8:
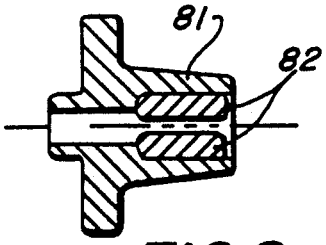
FIG. 8 shows a cross section view of still yet another embodiment of the T-shape section.

FIG. 8 shows another embodiment of the T-shape section wherein the damping strip 82 is in the interior of the central member 81 and the strings are all approximately in the plane of the string network. At least a portion of the string inside the central member will be in contact with the extending pad 81 for damping. In that respect, strings can also pass in internal openings made in the throat and be in contact with padding fastened in the interior of the throat.

A comment is to be made for the damping device made with respect to the frame in this invention. In a conventional frame, say, a tubular section, damping is sometimes made inside the tubing. It is entirely of a different order of magnitude to compare this invention and the said conventional. The width of a tennis tubular frame is at most 14 mm wide. The width of the central member in FIGS. 3, 7 and 8 is nominally about 20 mm, can be larger than 25 mm. Pading inside a limited tubular frame can not be made robust as the open space available in the invention.

In some frames, there is no need for a throat piece. The lateral portions extend and joins with the shank portion until the two separate pieces joins with the handle. In such designs, the T-shape cross section with damping pad used in the top portion and lateral portions may extend all the way to the handle. This is also a preferred embodiment for rackets with moderate ball force in which the strengthening intermediate member like the throat is not critical.

The merit of the present damping system is that the supporting surfaces for damping, are utilizing existing surfaces from the major structural members of the frame, such as 31 and 51, whose locations and sizes have already been fixed based on consideration of rigidity and strength of the frame, not from damping consideration. The addition of the damping device does not change the structure in any significant way. A breakthrough in the concept is the length of the portion of the string contacting the surface of the structure member through a cushioning pad retains its ability to axially stretch and hence retains the string network's performance associated with the string's ability to stretch while its vibration is damped. Furthermore, power is retained and control is improved as had been explained before. Such an innovative way to damp all the strings in the racket in a simple, cost effective and elegant way has not been achieved in prior art.

What is claimed is:

1. In a sports racket having a frame formed by a top portion, two opposed lateral portions connecting the top portion to a throat, a shank portion leading from the throat to a handle, and having a string network with longitudinal strings and cross strings defining a string network with its plane coinciding with the plane of the frame, the strings being arranged to enter and leave the frame, the improvement wherein the cross-section of the major portion of the frame is generally T-shaped, the frame including a central member having a plane of symmetry coinciding with the plane of the string network and defined by side walls, one on either side of said plane of symmetry, and a vertical member extending outwardly and symmetrically away from the plane of the string network, and including damping strips fastened on the surfaces of said side walls of said central member along major portions of the frame, said strips being in contact with the strings entering in and exiting from the frame at least when the strings are in vibration in the direction perpendicular to the plane of the string network, due to the impact of a ball against the racket.

2. The sports racket as defined in claim 1 wherein said central member is formed with openings and wherein the strings enter and exit said openings and said damping strips are fastened to said surfaces in the interior of said central member.

3. The sports racket as defined in claim 1 wherein at least a portion of said central member is enclosed by the strings when entering and exiting from the frame thereby wrapping around said portion of said central member for support, and contacting said damping strips which are fastened on said surfaces of said central member, at least during vibration.

4. The sports racket as defined in claim 3 including a string post in the shank region of the frame and wherein a major portion of the longitudinal strings pass through the throat of the frame and are anchored at said string post.

5. The sports racket as defined in claim 4 wherein the longitudinal strings wrap around said string post in a plane perpendicular to the plane of the string network.

6. The sports racket as defined in claim 1 wherein said damping strips are continuous, encircling the major portion of the frame surrounding the ball hitting area comprising the top, the lateral and the throat regions, one strip above the plane of the string network and the other below it.

7. The sports racket as defined in claim 6 wherein said encircling damping strips are enclosed between two separate string groups which are passing over the damping strips on their way to be anchored at the frame.

8. The sports racket as defined in claim 6 wherein the two encircling damping strips are separated by the string network imbedded between them.

9. The sports racket as defined in claim 1 wherein the width of the central member measured radially in the plane of the string network varies along the direction of the frame.

10. The sports racket as defined in claim 1 wherein said central and vertical members are formed with openings to reduce weight of the frame.

* * * * *